US006042065A

United States Patent [19]

Benjamin

[11] Patent Number: 6,042,065

[45] Date of Patent: Mar. 28, 2000

[54] COLLAPSIBLE NEEDLEWORK STAND

[76] Inventor: Benjamin C. Benjamin, 715 Dellwood La., Harbor Springs, Mich. 49740

[21] Appl. No.: 08/901,199

[22] Filed: Jul. 28, 1997

[51] Int. Cl.[7] ..... A47F 5/00

[52] U.S. Cl. ..... 248/125.1; 38/102.1; 38/102.2; 248/125.8; 248/449; 248/676; 269/69

[58] Field of Search ..... 248/125.1, 125.8, 248/448, 449, 454, 460, 676, 678; 38/102.1, 102.2, 102.4, 102.8, 102.9; 269/71, 69, 249, 269

[56] References Cited

U.S. PATENT DOCUMENTS

| | | | |
|---|---|---|---|
| 1,357,737 | 11/1920 | Solaini | 38/102.2 |
| 1,564,358 | 12/1925 | Klein | 248/172 |
| 1,680,610 | 8/1928 | Harmon | 38/102.6 |
| 1,908,470 | 5/1933 | Beuttner | 248/229.25 |
| 2,464,031 | 3/1949 | Fiedel | 248/167 |
| 2,628,142 | 2/1953 | Dubach | 248/413 |
| 3,309,803 | 3/1967 | Wilson | 38/102.2 |
| 3,738,606 | 6/1973 | Millen | 248/449 |
| 3,804,355 | 4/1974 | Uroshevich | 248/124.1 |
| 3,847,335 | 11/1974 | Ross | 248/166 |
| 3,906,648 | 9/1975 | Bard | 38/102.2 |
| 3,955,722 | 5/1976 | Bard | 223/106 |
| 4,175,343 | 11/1979 | Mathews | 38/102.1 |
| 4,292,748 | 10/1981 | Miller | 38/102 |
| 4,378,646 | 4/1983 | Mazeika | 38/102 |
| 4,561,177 | 12/1985 | Rancer | 29/721 |
| 4,660,814 | 4/1987 | Shader et al. | 269/16 |
| 4,747,569 | 5/1988 | Hoshino | 248/291.1 |
| 4,927,120 | 5/1990 | Wang | 248/676 |
| 4,949,928 | 8/1990 | Hoshino | 248/291.1 |
| 5,027,989 | 7/1991 | Nevius | 223/120 |
| 5,119,572 | 6/1992 | Graham | 38/102.2 |
| 5,121,890 | 6/1992 | Komada | 248/122.1 |
| 5,141,211 | 8/1992 | Adams, Jr. | 269/16 |
| 5,330,143 | 7/1994 | Rich et al. | 248/161 |
| 5,357,699 | 10/1994 | Padawer | 38/102 |
| 5,359,461 | 10/1994 | Rice et al. | 359/879 |
| 5,383,637 | 1/1995 | Biber | 248/291.1 |
| 5,771,613 | 6/1998 | Geils et al. | 38/102.21 |

*Primary Examiner*—Ramon O. Ramirez
*Assistant Examiner*—Tan Le
*Attorney, Agent, or Firm*—Harness, Dickey & Pierce, PLC

[57] ABSTRACT

A collapsible support structure supports a frame in a horizontal position, a vertical position or an intermediate position halfway between the horizontal and the vertical position. The support structure is adjustable in all positions of the frame to position the frame at different heights depending on a particular need. The frame is held by a clamping assembly which can accommodate various designs and sizes of frames. The support structure can be switched from an open position where it supports the frame in a variety of positions to a collapsed position where the overall size of the support structure is minimized to simplify the transportation and storage of the support structure.

44 Claims, 4 Drawing Sheets

COLLAPSIBLE NEEDLEWORK STAND

FIELD OF THE INVENTION

The present invention relates to work holders that maintain a workpiece in a stationary position while a person modifies the workpiece. More particularly, the present invention relates to a collapsible needlework stand which supports a needlework frame in multiple positions to enable the person to comfortably work on the needlework fabric.

BACKGROUND AND SUMMARY OF THE INVENTION

Needlework and fancy stitchery have been in practice for centuries and since the work is done by hand, the resulting works both serve a useful purpose as well as being treasured heirlooms and works of art. Recently, there has been a continuing growth of interest and participation by individuals which has led to a proliferation of designs, devices and apparatus to aid in the field of needlework and the like. Many work supporting frames, such as embroidery hoops, tapestry frames, rug frames and the like have been provided for holding a piece of base material which is usually of a woven character. The piece of base material is held in a stretched or taut condition while an individual works on a design thereon using a needle and one or more colored threads or yarns to enhance the appearance of the base material. During this operation, the relatively small frames are held in one hand while the other hand is used for manipulating the needle and thread. Frequently, a large number of colors are to be worked into the base material which then makes in necessary to do a lot of knotting and cutting of the threads. Substantially all of the knotting and cutting are done on the reverse side of the base material so as to not detract from the design on the front side. This necessitates a frequent reversing of the working frame from the front to the back and from the back to the front.

Various prior art support structures and workpiece holders have attempted to address the problems of a convenient, adjustable support of these working frames to allow positioning of the working frame to a location convenient for the individual. Each of the prior art devices has attempted to bring the work closer to the individual, to enhance the convenience and comfort of the needleworker as well as to provide a stable base upon which to mount needlework or similar working frames. While all of these prior art support structures have provided acceptable results for the needleworkers, the continued development of the support structures have been directed towards providing additional features for the needleworker while continuing to provide the stable base upon which to mount the working frames.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
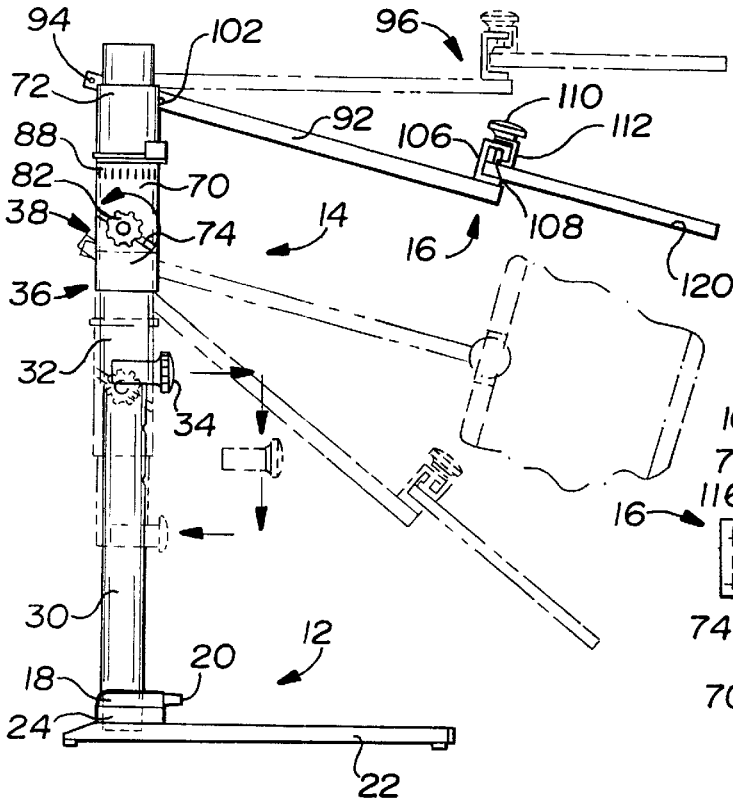
FIG. 1 is a side elevational view of the needlework stand in accordance with carrying out the present invention.

Referring now to the drawings in which like reference numerals designate like or corresponding parts throughout the several views, there is disclosed in FIGS. 1–4 a collapsible needlework stand in accordance with the present invention which is designated generally, by the reference numeral 10. Needlework stand 10 comprises a base assembly 12, an upright assembly 14 and a support assembly 16. Base assembly 12 comprises a base 18, a base locking screw 20 and a pair of base legs 22.

Figure 3:
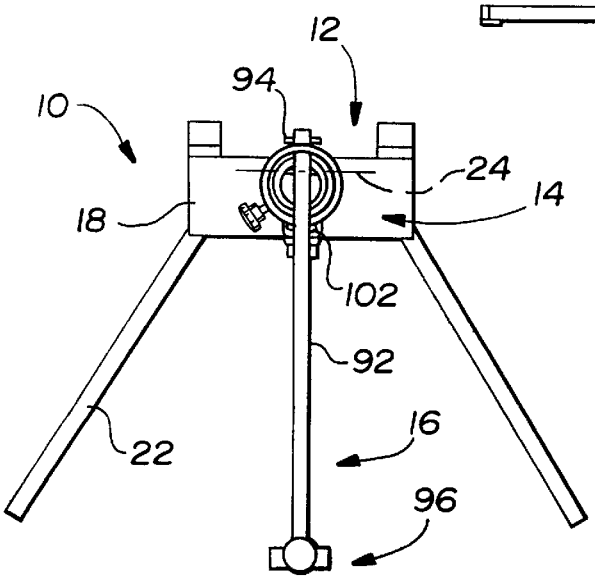
FIG. 3 is a top plan view of the needlework stand shown in FIG. 1.
Figure 4:
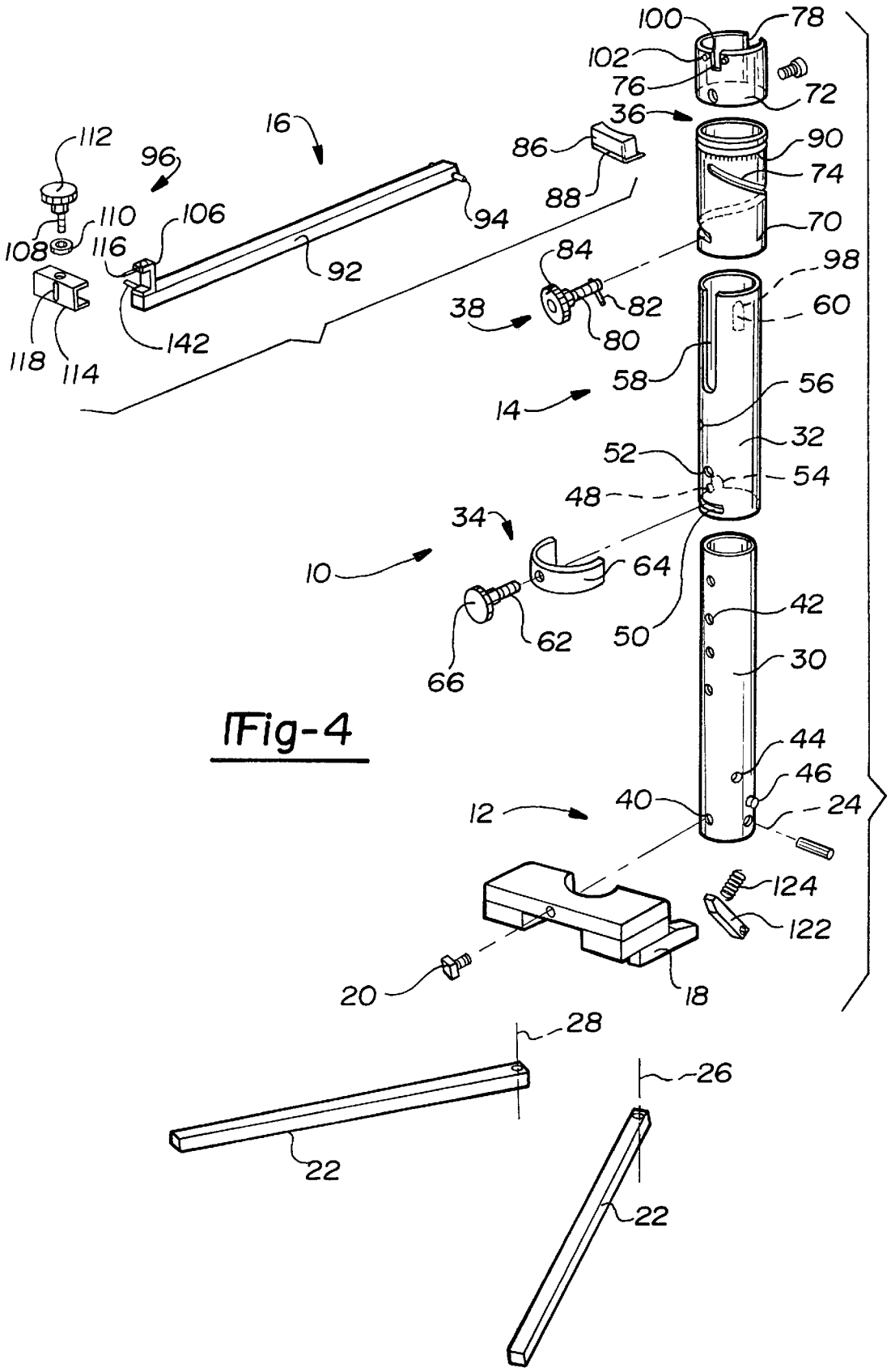
FIG. 4 is an exploded perspective view of the needlework stand shown in Figure.
Figure 5:
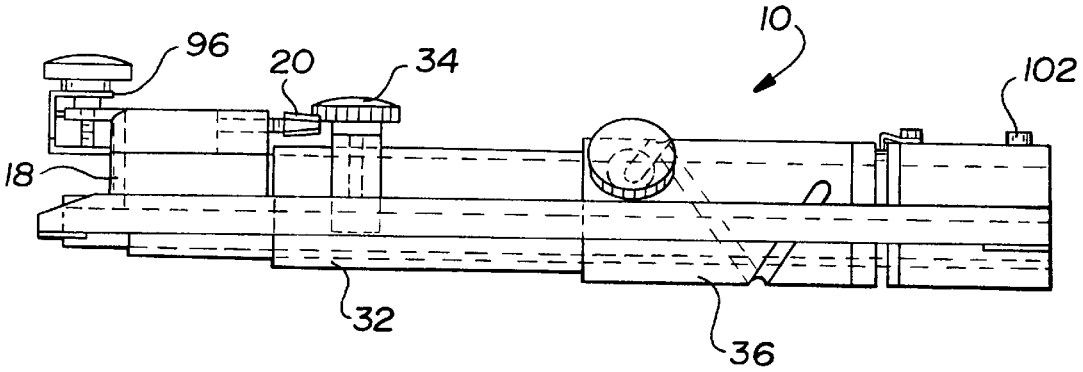
FIG. 5 is a side elevational view of the needlework stand shown in FIG. 1 with the stand shown in a collapsed condition.
Figure 6:
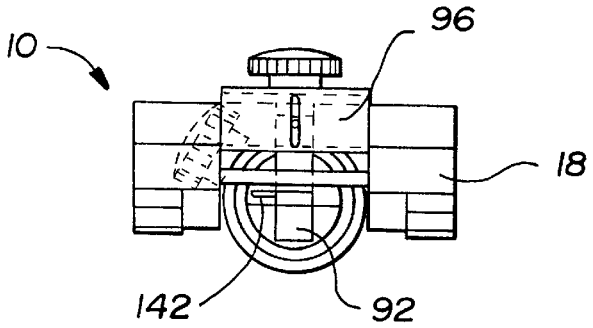
FIG. 6 is a front elevational view of the collapsed needlework stand shown in FIG. 5.
Figure 7:
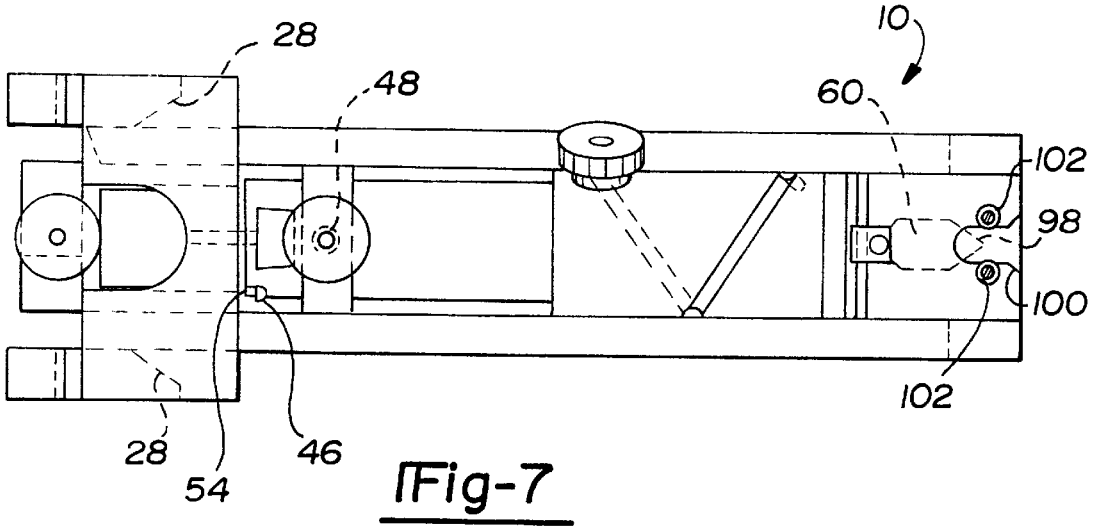
FIG. 7 is a top plan view of the needlework stand shown in FIG. 5.

Base 18 is pivotably secured to upright assembly 14 such that base 18 pivots about an axis 24 from an open position as shown in FIGS. 1–4 to a collapsed position as shown in FIGS. 5–7. The pivotable motion of base 18 between its open position and its collapsed position is approximately 270° of rotation about axis 24. Base locking screw 20 extends through base 18 and is threadingly received by upright assembly 14 to lock base 18 in its open position. When base 18 is located in its collapsed position, base locking screw 20 is disengaged from upright assembly 14 and is prohibited from disengagement with base 18 by methods known well in the art. Base legs 22 are each pivotably secured to base 18 such that each base leg 22 pivots about an axis 26 from an open position an shown in FIGS. 1–4 to a collapsed position as shown in FIGS. 5–7. When base legs 22 are located in their open position, as shown in FIGS. 1–4, they form a V-shaped support structure to provide stability to needlework stand 10. A stop 28 (shown in FIG. 7) is provided on base 18 to position legs 22 into their open position. When base legs 22 are located in their collapsed position as shown in FIGS. 5–7, they are positioned adjacent to and parallel with upright assembly 14.

Upright assembly 14 comprises lower cylinder 30, an outer sliding cylinder 32, a height adjustment pin 34, a rotating cam cylinder 36 and a cam tightening screw 38. Lower cylinder 30 pivotably receives base 18 of base assembly 12 and it defines an aperture 40 which threadingly receives base locking screw 20. Lower cylinder 30 also defines a plurality of height adjustment apertures 42, a retaining aperture 44 and a locating stud 46 which are used for locating outer sliding cylinder 32 with respect to lower cylinder 30.

Outer sliding cylinder 32 is slightingly received over lower cylinder 30 and is movable between an open position as shown in FIGS. 1–4 and a collapsed position as shown in FIGS. 5–7. Outer sliding cylinder 32 defines a positioning aperture 48, a positioning slot 50, a retaining aperture 52, a locating slot 54, a cam screw aperture 56, a front guide slot 58 and a rear support aperture 60. The height of outer sliding cylinder 32 with respect to lower cylinder 30 in its open position is adjusted by aligning positioning aperture 48 with one of the plurality of height adjustment aperture 42 and inserting height adjustment pin 34 through the aligned apertures 42 and 48. Apertures 42 and 48 are sized such that once adjustment pin 34 is inserted through the apertures, rotation of outer sliding cylinder 32 with respect to lower cylinder 30 is prohibited. As an alternative, when it is desired to allow limited rotation of outer sliding cylinder 32 with respect to lower cylinder 30, positioning slot 50 is aligned with one of the plurality of height adjustment apertures 42 and height adjustment pin 34 is inserted through slot 50 and the selected aperture 42. Positioning slot 50 permits limited rotation of outer sliding cylinder 32 with respect to lower cylinder 30 with the amount of permissible rotation being defined by the width of slot 50. The movement of outer sliding cylinder 32 between its open position as shown in FIGS. 1–4 and its closed position as shown in FIGS. 5–7 is accomplished by removing height adjustment pin 34 and sliding lower cylinder 30 into outer sliding cylinder 32. Simultaneously, outer sliding cylinder 32 is rotated approximately 180° such that locating stud 46 engages locating slot 54. When locating stud 46 engages locating slot 54, retaining aperture 52 of outer sliding cylinder 32 is aligned with retaining aperture 44 of lower cylinder 30. Height adjustment pin 34 is inserted through apertures 52 and 44 to retain outer sliding cylinder 32 in its collapsed position.

Height adjustment pin 34 comprises a stud 62, a flexible collar 64 and a knob 66. Stud 62 is sized to be slightingly received by apertures 42, 44, 48 and 52 as well as by slot 50. Collar 64 is sized to be slightly smaller in diameter than the diameter of outer sliding cylinder 32. Collar 64 extends circumferentially greater than 180° and because of its flexible nature and its size, collar 64 will snap on and off of outer sliding cylinder 32 to provide an retention feature for height adjustment pin 34. Knob 66 is attached to collar 64 and stud 62 to provide convenience to the individual when adjusting and/or collapsing needlework stand 10.

Rotating cam cylinder 36 is slightingly received over outer sliding cylinder 32. Rotating cam cylinder 36 comprises lower cam cylinder 70 and an upper support cylinder 72. Lower cam cylinder 70 defines a spiral slot 74 and upper support cylinder 72 defines a front support slot 76 and a rear guide slot 78. Slots 76 and 78 are designed to align with slot 58 and aperture 60, respectfully, to accept support assembly 16 as will be described later herein. Cam tightening screw 38 comprises a threaded stud 80, a cross pin 82 and a knob 84. Rotating cam cylinder 36 is assembled to outer sliding cylinder 32 by sliding cylinder 36 over cylinder 32 and aligning a portion of spiral slot 7 with cam screw aperture 56. Threaded stud 80 is then inserted through aperture 56 and spiral slot 74 from the inside of cylinder 32. Threaded stud 80 is secured against rotation to outer sliding cylinder 32 by inserting cross pin 82 into a groove formed in the inside surface of outer sliding cylinder 32 by other means known well in the art. Threaded stud 80 and cross pin 82 are thus embedded into the wall of outer sliding cylinder 32 in order to avoid any interference with lower cylinder 30 when outer sliding cylinder 32 is slid over lower cylinder 30. Knob 84 is then threadingly engaged with threaded stud 80. Once assembled, when knob 84 is tightened, knob 84 compresses lower cam cylinder 70 against outer sliding cylinder 32 prohibiting rotation of lower cam cylinder 70 with respect to outer sliding cylinder 32. When it is desired to rotate lower cam cylinder 70 with respect to outer sliding cylinder 32, knob 84 is loosened to allow the rotation. The engagement of threaded stud 80 with aperture 56 and spiral slot 74 will result in longitudinal movement of lower cam cylinder 70 with respect to outer sliding cylinder 32 when lower cam cylinder 70 is rotated. The rotating of lower cam cylinder 70 and the subsequent longitudinal movement of lower cam cylinder 70 with respect to outer sliding cylinder 32 operates to move upper support cylinder 72 which in turn operates to adjust the angle of support assembly 16 as described below.

Upper support cylinder 72 is rotatably coupled to lower cam cylinder 70 and it includes a support 86 which is secured to cylinder 70. Support 86 engages a slot in lower cam cylinder 70 to allow rotation of cam cylinder 70 with respect to cylinder 72 but support 86 prohibits axial or longitudinal movement of upper support cylinder 72 with respect to lower cam cylinder 70. Support 86 or upper support cylinder 72 can be provided with an indicator 88 which works in conjunction with a scale 90 located on lower cam cylinder 70 to provide a relative indicator of the position of rotation cam cylinder 36 with respect to outer sliding cylinder 32 and thus the position or angle of support assembly 16.

Figure 2:
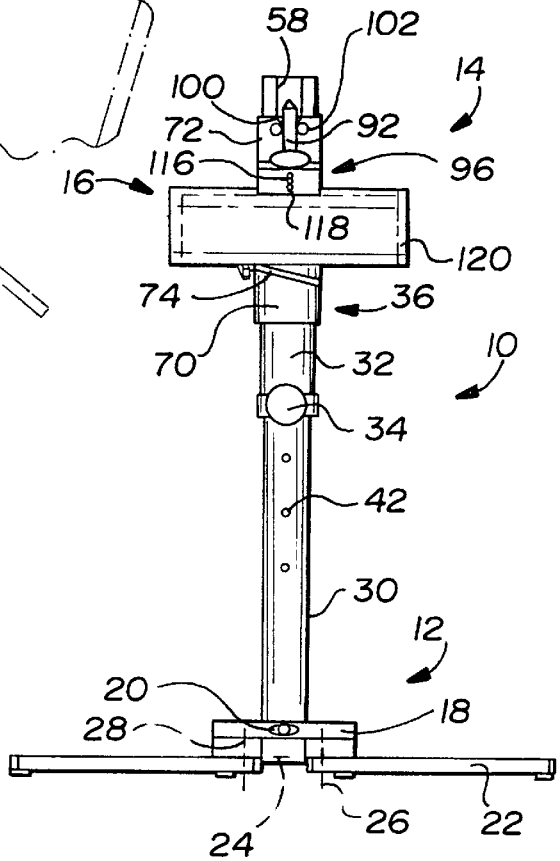
FIG. 2 is a front elevational view of the needlework stand shown in FIG. 1.

Support rod assembly 16 comprises a generally square clamping bar 92, a retention pin 94 and a clamp assembly 96. Retaining pin 94 extends through one end of clamping bar 92 and clamp assembly 96 is secured to the opposite end. When outer sliding cylinder 32 is located in its open position, as shown in FIGS. 1–4, slot 76 is designed to align with slot 58 and slot 78 is designed to align with aperture 60. Aperture 60 in outer cylinder 32 is designed to have a width or horizontal dimension as shown in FIGS. 1, 2 and 4 which is slightly larger than the diagonal width of clamping bar 92 which thus permits rotation of clamping bar 92 within aperture 60. Aperture 60 is designed to include a generally triangular extension 98 which, in the vertical direction as shown in FIGS. 1, 2 and 4, gives aperture 60 a height which will allow retention pin 94 and thus clamping bar 92 to pass through aperture 60 when retention pin 94 is positioned vertically. The triangular shape of extension 98 provides support for clamping bar 92 when clamping bar 92 is rotated to a position between the horizontal and vertical positions shown in FIG. 1 as detailed below. Once inserted through aperture 60 in the vertical position, clamping bar 92 can be rotated to a horizontal position as shown in FIGS. 1, 2 and 4. The length of retention pin 94 is greater than the width of aperture 60 prohibiting removal of clamping bar 92 when retention pin 94 is horizontal. Slot 58 extends into outer cylinder 32 and is designed to have a width or horizontal dimension as shown in FIGS. 1, 2 and 4 which permits rotation of clamping bar 92. Slot 76 in upper support cylinder 72 of rotating cam cylinder 36 is designed to have a width or horizontal dimension as shown in FIGS. 1, 2 and 4 which is slightly larger than the square width of clamping bar 92. Slot 76 includes an angled inlet 100 to guide the insertion of clamping bar 92. Angled inlet 100 is sized to provide for the front support of clamping bar 92 and triangular shaped extension 98 which provides the rear support for clamping bar 92 when clamping bar 92 is positioned such that a diagonal extending between the corners of bar 92 is positioned vertically with respect to FIGS. 1, 2 and 4. This position is halfway between the horizontal position and the vertical position shown in FIG. 1. A rotating rubber friction disc 102 is positioned on each side of slot 76 to pinch the sides of clamping bar 92 when it is inserted into slot 76. This provides retention for clamping bar 92 by keeping it from sliding through slot 76. This allows slot 76 to slidingly accept clamping bar 92 while at the same time prohibiting rotation and providing support to clamping bar 92. Slot 78 is designed to have a width generally equal to the width of aperture 60. The assembly of support rod assembly 16 to upright assembly 14 begins by rotating support rod assembly 16 to position retention pin 94 in a generally vertical position relative to FIGS. 1, 2 and 4. Support rod assembly 16 can then be inserted through slot 58 and then aperture 60. Once retention pin 94 is inserted through aperture 60 it is rotated to a generally horizontal position as shown in FIGS. 1, 2 and 4. Support rod assembly 16 is then moved to engage slots 76 and 78 such that support rod assembly 16 is supported by upper support cylinder 72 of rotating cam cylinder 36.

Once support rod assembly 16 is assembled to upright assembly 14, the angle of support rod assembly 16 and thus the height of clamp assembly 96 will be determined by the longitudinal position of rotating cam cylinder 36 with respect to outer sliding cylinder 32. As shown in FIGS. 1, 2 and 4, support rod assembly 16 will be supported by the upper closed portion of aperture 60 and by the lower or end portion of slot 76. In order to adjust the angle of support rod assembly 16 and thus the height of clamp assembly 96, knob 84 is loosened allowing the rotation of lower cam cylinder 70. The engagement of threaded stud 80 with aperture 56 and spiral slot 74 will result in longitudinal movement of lower cam cylinder 70 which in turn results in the longitudinal movent of upper support cylinder 72. Since upper support cylinder 72 supports one side of support rod assembly 16, the longitudinal movement of upper support cylinder 72 adjusts the angle of support rod assembly 16 and the height of clamp assembly 96.

Clamp assembly 96 comprises a generally U-shaped bracket 106, a clamping bolt 108, a retention nut 110 a knob 112 and a generally U-shaped clamp 114. Support bracket 106 is fixedly secured to the end of clamping bar 92 opposite to retention pin 94. Clamping bolt 108 is threadingly received within a threaded aperture of support bracket 106 and knob 112 is fixedly secured to clamping bolt 108 to facilitate the rotation of bolt 108 with respect to support bracket 106. Clamping bolt 108 extends through one arm of U-shaped clamp 114 and is designed to extend through an aperture on the other arm of U-shaped clamp 114. Retention nut 110 is threaded onto bolt 108 and is positioned adjacent clamp 114 to locate bolt 108 with respect to clamp 114. Nut 110 is tightened sufficiently to locate bolt 108 but still permit rotation of bolt 108 with respect to clamp 114. Nut 110 is held in place by an adhesive or by other means known well in the art. U-shaped clamp 114 engages support bracket 106 as shown in FIG. 1. A guide pin 116 extending from support bracket 106 engages a slot 118 within clamp 114 to guide the vertical movement of clamp 114 with respect to bracket 106 and prohibit rotation of clamp 114 with respect to support bracket 106. Thus, as shown in FIG. 1, when a frame 120 is positioned between bracket 106 and clamp 114, clamping bolt 108 can be rotated by turning knob 112 to tighten clamp 114 against frame 120 and frame 120 against bracket 106. The engagement of bolt 108 and nut 110 with both arms of U-shaped clamp 114 and the engagement of pin 116 with slot 118 provides for the retention of clamp 114 to bracket 106 when bolt 108 is loosened and frame 120 is removed from clamp assembly 96.

When needlework stand 10 is in its open position, as shown in FIGS. 1–3, the position of frame 120 can be adjusted for height by repositioning outer sliding cylinder 32 with respect to lower cylinder 30 and inserting adjustment pin 34 into a different one of the plurality of apertures 42. In addition the height of frame 120 can be adjusted by loosening knob 82 to allow the rotation of rotating cam cylinder 36 to change the angle of support assembly 16. In addition to adjusting the height of frame 120, frame 120 can be changed from the horizontal position as shown in FIGS. 1–3 to a vertical position as shown in phantom in FIG. 1. This is accomplished by disengaging support assembly 16 from slots 76 and 78, rotating support assembly 16 approximately 90° within slot 58 and aperture 60 and reengaging support assembly 16 with slots 76 and 78.

When needlework stand 10 is in its open position as shown in FIGS. 1–3, it provides both support for and adjustment to frame 120 to make it convenient and comfortable for an individual to perform work on the particular piece of work supported by frame 120. At times, it may be desired to store and/or transport needlework stand 10. The present invention provides collapsibility to stand 10 in order to change stand 10 from its open position, as shown in FIGS. 1–3 to its collapsed position as shown in FIGS. 5–7. The collapsibility of stand 10 is accomplished by performing the following steps. It should be understood that the listing of the following steps does not require the steps to be performed in any particular order.

Support assembly 16 is disengaged from slots 76 and 78 and rotated to position retention pin 94 in a vertical position relative to FIG. 1. Support assembly 16 is then removed from aperture 60 and slot 58 freeing support assembly 16 from upright assembly 14. Support assembly 16 can then be inserted into the bottom end of lower cylinder 30 of upright assembly 14 as shown in FIGS. 5–7. The length of retention pin 94 is short enough to allow for its insertion into upright assembly 14 while at the same time retention pin 94 guides support assembly 16 into the lower end of lower cylinder 30 to avoid contact between clamping bar 92 and any burrs or the like that may be present within the internal diameter of lower cylinder 30. A retention lever 122 is pivotally secured within lower cylinder 30 of upright assembly 14 to retain support assembly 16 within lower cylinder 30. A biasing spring 124 biases lever 122 against support assembly 16 for retention.

Base locking screw 20 is loosened to disengage screw 20 from lower cylinder 30 of upright assembly 14. This allows for the approximately 270° rotation of base 18 from the open position shown in FIGS. 1–3 to the collapsed position shown in FIGS. 5–7. Base legs 22 are pivoted from their open position as shown in FIGS. 1–3 to their collapsed position as shown in FIGS. 5–7.

Height adjustment pin 34 is removed from lower cylinder 30 and outer sliding cylinder 32. Outer sliding cylinder is slid and rotated from its open position as shown in FIGS. 1–3 to its collapsed position as shown in FIGS. 5–7. In this collapsed position, locating stud 46 engages locating slot 54 causing the alignment of apertures 52 and 44. Height adjustment pin 34 is inserted into apertures 52 and 44 to retain upright assembly 14 in its collapsed position.

Thus, needlework stand 10 is transformed from its open position as shown in FIGS. 1–3 where it supports frame 120 and provides adjustability to frame 120 to facilitate work to it compact collapsed position as shown in FIGS. 5–7 to simplify storage and/or transportation of stand 10.

Figure 8:
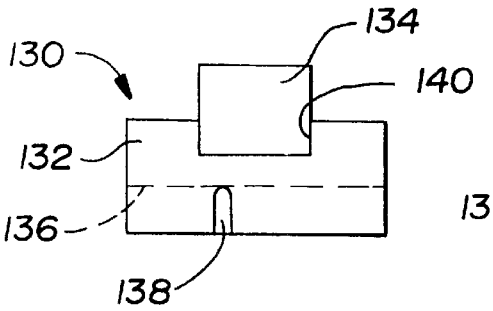
FIG. 8 is an end elevational view of a clamping insert in accordance with the present invention.
Figure 9:
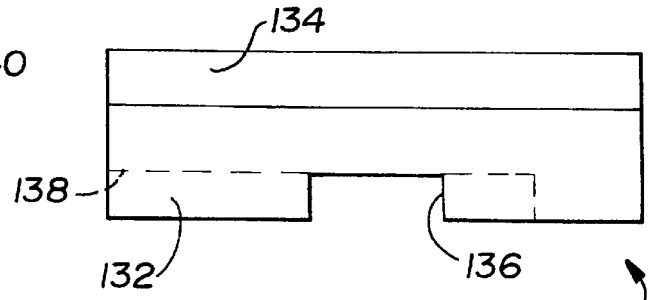
FIG. 9 is a side elevational view of the clamping insert shown in FIG. 8.
Figure 10:
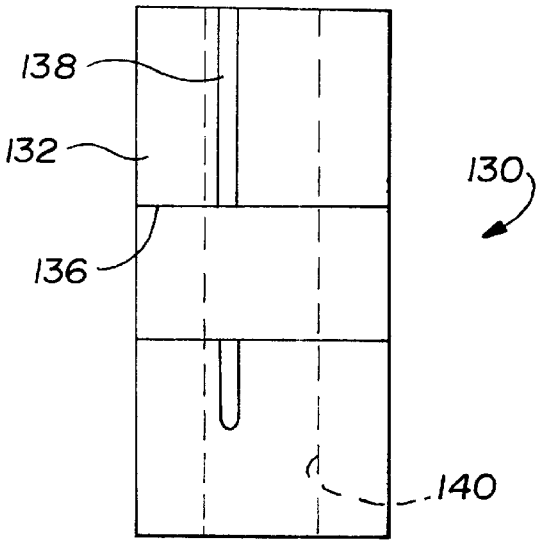
FIG. 10 is a bottom plan view of the clamping insert shown in FIG. 8.

FIGS. 8–10 illustrate a two piece insert 130 which improves both the versatility and stability of clamp assembly 96. Insert 130 includes a lower insert 132 and an upper insert 134. Lower insert 132 is a generally rectangular shaped block having a bracket slot 136, a retaining groove 138 and an insert channel or slot 140. Upper insert 134 is a generally rectangular shaped block which is similar in size to a typical frame. Upper insert 134 is received within insert slot 140 as described below.

Figure 11:
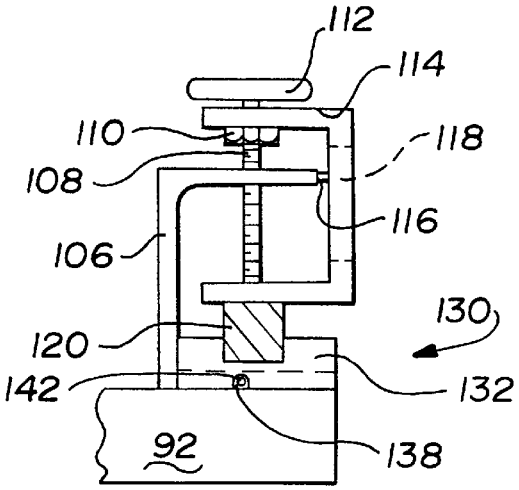
FIG. 11 is a side view showing the clamping insert shown in FIGS. 8–10 in use with the clamp of the needlework stand shown in FIG. 1–4.

Referring now to FIG. 11, lower insert 132 is shown in conjunction with clamp assembly 96 clamping frame 120 to clamping bar 92. Lower insert 132 is positioned on clamp assembly 96 by engaging bracket slot 136 with the lower arm of U-shaped bracket 106. The width and depth of slot 136 are chose to be similar in size to the lower arm of U-shaped bracket 106 to provide a slip fit between the two pieces. When lower insert 132 engages bracket 106, retaining groove 138 engages a retaining pin 142 extending from bracket 106. The engagement between groove 138 and pin 142 helps to stabilize the connection between lower insert 132 and bracket 106. Frame 120 is then inserted into insert slot 140 and clamp assembly 96 is tightened by rotating knob 112. The engagement between frame 120 and slot 140 thus prohibits any movement of frame 120 with respect to clamp assembly 96. Lower insert 132 is preferably made from wood thus enabling a collection of lower inserts 132 to be provided to accommodate a variety of sizes for frame 120.

Figure 12:
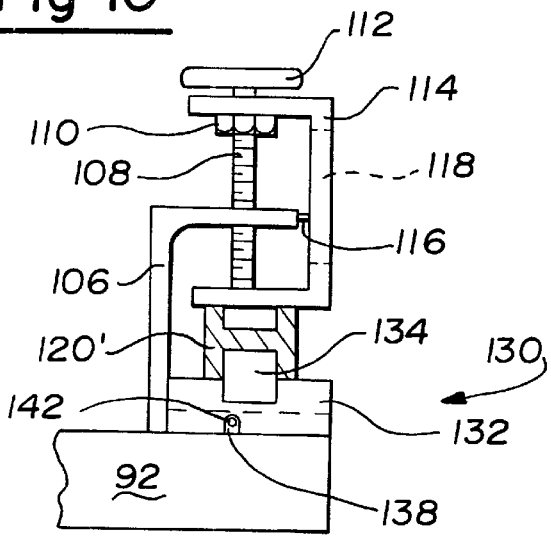
FIG. 12 is a side view showing an alternate use of the clamping insert shown in FIGS. 8–10 in use with the clamp of the needlework stand shown in FIGS. 1–4.

Referring now to FIG. 12, the use of upper insert 134 in conjunction with lower insert 132 is illustrated. FIG. 12 illustrates a frame 120' which is generally H-shaped thus providing a groove in one or more of its sides. For this type of a frame, upper insert 134 is inserted into slot 140 thus providing a tab for engagement with the groove in frame 120'. Similar to lower insert 132, upper insert 134 is also preferably made from wood to allow a variety of sizes for frame 120'. The engagement between upper insert 134 and frame 120' prohibits the movement of frame 120' with respect to clamp assembly 96.

While the above detailed description describes the preferred embodiment of the present invention, it should be understood that the present invention is susceptible to modification, variation and alteration without deviating from the scope and fair meaning of the subjoined claims.

What is claimed is:

1. A support structure comprising:

a base assembly defining a surface;

an upright secured to said base assembly, said upright having a front slot defining a front supporting location and a rear aperture defining a rear supporting location;

a support rod cantilevered at a support angle with respect to said surface within said front slot and said rear aperture, said support rod engaging and rear supporting locations, one of said supporting locations being movable with respect to said surface of said base to change said support angle.

2. The support structure according to claim 1 wherein, said upright assembly includes a first cylinder defining said rear aperture and a second cylinder defining said front slot.

3. The support structure according to claim 2 wherein, one of said cylinders is movable with respect to the other cylinder to change said support angle.

4. The support structure according to claim 2 wherein, said first cylinder includes a fixed stud and said second cylinder is a non-rotating cylinder, said upright further including a third rotating cylinder, said third rotating cylinder having a rotating cylindrical wall defining a spiral slot, said fixed stud engaging said spiral slot such that rotation of said second cylinder with respect to said first cylinder moves said front slot with respect to said rear aperture.

5. The support structure according to claim 1 wherein, said support rod includes a clamp assembly, said clamp assembly comprising a U-shaped support bracket having a clamp pin extending from an arm of said support bracket and a U-shaped clamp engaged with said U-shaped support bracket and defining a slot, said pin engaging said clamp slot to prohibit rotation of said clamp with respect to said support bracket.

6. The support structure according to claim 1 wherein, said upright includes a disc disposed on both sides of said front slot, said discs resiliently engaging said support rod.

7. The support structure according to claim 1 wherein, said upright includes a lower cylinder and an outer cylinder slidingly engaging said lower cylinder, said upright further including an adjustment pin which engages a first aperture in said outer cylinder and a second aperture in said lower cylinder, said adjustment pin being resiliently engaged with said outer cylinder.

8. The support structure according to claim 7 wherein, said first aperture in said outer cylinder is a slot.

9. A support structure comprising:

a base assembly defining a surface;

an upright secured to said base assembly and defining a longitudinal axis, said upright comprising:

a first cylinder a first cylindrical wall defining a rear aperture and including a radially extending fixed stud;

a second cylinder slidingly received over said first cylinder, said second cylinder having a second cylindrical wall defining a spiral slot engaging said stud; and a third cylinder slidingly received over said first cylinder in engagement with said second cylinder, said third cylinder having a third cylindrical wall defining a front slot;

wherein rotation of said second cylinder with respect to said first cylinder moves said second and third cylinder along said longitudinal axis; and a support rod cantilevered at a support angle with respect to said base within said front slot and said rear aperture, said movement of said second and third cylinder along said longitudinal axis being operative to change said support angle.

10. The support structure according to claim 9 wherein, said front slot defines a front supporting location and said rear aperture defines a rear supporting location, said support rod engaging both said front and rear supporting locations.

11. The support structure according to claim 9 wherein, said support rod includes a clamp assembly, said clamp assembly comprising a U-shaped support bracket having a pin extending from an arm of said support bracket and a U-shaped clamp engaged with said U-shaped support bracket and defining a clamp slot, said pin engaging said clamp slot to prohibit rotation of said clamp with respect to said support bracket.

12. The support structure according to claim 9 wherein, said upright includes a disc disposed on both sides of said front slot, said discs resiliently engaging said support rod.

13. The support structure according to claim 9 wherein, said upright assembly further comprises a fourth cylinder pivotably secured to said base assembly, said first cylinder being in sliding engagement with said fourth cylinder, said upright further including an adjustment pin which engages a first aperture in said first cylinder and a second aperture in said fourth cylinder, said adjustment pin being resiliently engaged with said first cylinder.

14. The support structure according to claim 13 wherein, said first aperture in said first cylinder is a slot.

15. A support structure comprising:

a base assembly defining a surface;

an upright secured to said base assembly, said upright having a front slot defining a front supporting location and a rear aperture defining a rear supporting location;

a support rod cantileved at a support angle with respect to said surface within said front slot and said rear aperture, said support rod assembly including a clamp assembly for clamping a frame, said clamp assembly comprising:

a U-shaped support bracket secured to one end of said support rod assembly;

a U-shaped clamp engaging said U-shaped support bracket;

a bolt rotatably secured to said U-shaped clamp and threadingly received by said U-shaped support bracket;

a lower insert secured against rotation to said support bracket, said lower insert including means for supporting said frame.

16. The support structure according to claim 15 wherein, said means for supporting said frame includes an upper insert being disposed within a channel such that said upper insert engages said frame.

17. The support structure according to claim 15 wherein, said means for supporting said frame includes a channel.

18. The support structure according to claim 15 wherein, said lower insert defines a first slot in engagement with said support bracket and a second slot in engagement with a pin extending from said support bracket.

19. The support structure according to claim 15 wherein, said support rod engages both said front and rear supporting locations.

20. The support structure according to claim 19 wherein, one of said supporting locations is movable with respect to said surface of said base to change said support angle.

21. The support structure according to claim 15 wherein, said upright includes a first cylinder having a first cylindrical wall defining said rear aperture and a second cylinder having a second cylindrical wall defining said front slot.

22. The support structure according to claim 21 wherein, said support rod engages both said front and rear supporting locations.

23. The support structure according to claim 22 wherein, one of said cylinders is movable with respect to the other cylinder to change said support angle.

24. The support structure according to claim 21 wherein, said first cylinder includes a fixed stud and said second cylinder is a non-rotating cylinder, said upright further including a third rotating cylinder, said rotating cylinder having a rotating cylindrical wall defining a spiral slot, said fixed stud engaging said spiral slot such that rotation of said second cylinder with respect to said first cylinder moves said front slot with respect to said rear aperture.

25. The support structure according to claim 15 wherein, said upright includes a disc disposed on both sides of said front slot, said discs resiliently engaging said support rod.

26. The support structure according to claim 15 wherein, said upright includes a lower cylinder and an outer cylinder slidingly engaging said lower cylinder, said upright further including an adjustment pin which engages a first aperture in said outer cylinder and a second aperture in said lower cylinder, said adjustment pin being resiliently engaged with said outer cylinder.

27. The support structure according to claim 26 wherein, said first aperture in said outer cylinder is a slot.

28. A support structure comprising:

a base assembly defining a surface;

an upright including a tube defining a central bore secured to said based assembly, said upright a front slot defining a front supporting location and a rear aperture defining a rear supporting location, said tube being pivotable between an open position wherein said tube is generally perpendicular to said surface and a collapsed position wherein said tube is generally parallel to said surface;

a support rod engaged with said upright assembly, said support rod being movable between an open position wherein said support rod is cantilevered at a support angle within said front slot and said rear aperture and a collapsed position wherein said support rod is disposed within said central bore of said tube.

29. The support structure according to claim 28 wherein said base assembly comprises a base and a pair of legs pivotably secured to said base.

30. The support structure according to claim 28 wherein said tube pivots approximately 270° between said open position and said collapsed position.

31. The support structure according to claim 28 wherein, said support rod engages both said front and rear supporting locations in said open position.

32. The support structure according to claim 31 wherein, one of said supporting locations is movable with respect to said surface of said base to change said support angle.

33. The support structure according to claim 28 wherein, said upright includes a first cylinder having a first cylindrical wall defining said rear aperture and a second cylinder having a second cylindrical wall defining said front slot.

34. The support structure according to claim 33 wherein, said support rod engages both said front and rear supporting locations in said open position.

35. The support structure according to claim 34 wherein, one of said cylinders is movable with respect to the other cylinder to change said support angle.

36. The support structure according to claim 33 wherein, said first cylinder includes a fixed stud and said second cylinder is a non-rotating cylinder, said upright further including a third rotating cylinder, said third rotating cylinder having a rotating cylindrical wall defining a spiral slot, said fixed stud engaging said spiral slot such that rotation of said second cylinder with respect to said first cylinder moves said front slot with respect to said rear aperture.

37. The support structure according to claim 28 wherein, said support rod includes a clamp assembly, said clamp assembly comprising a clamp U-shaped support bracket having a clamp pin extending from an arm of said support bracket and a U-shaped clamp engaged with said clamp U-shaped support bracket and defining a slot, said pin engaging said slot to prohibit rotation of said clamp with respect to said support bracket.

38. The support structure according to claim 28 wherein, said upright includes a disc disposed on both sides of said front slot, said discs resiliently engaging said support rod when said support rod is in its open position.

39. The support structure according to claim 28 wherein, said upright assembly includes a lower cylinder and an outer cylinder slidingly engaging said lower cylinder, said upright assembly further including an adjustment pin which engages a first aperture in said outer cylinder and a second aperture in said lower cylinder, said adjustment pin being resiliently engaged with said outer cylinder.

40. The support structure according to claim 39 wherein, said first aperture in said outer cylinder is a slot.

41. A clamp assembly for supporting a frame, said clamp assembly comprising:

a U-shaped support bracket;

a U-shaped clamp engaging said U-shaped support bracket;

a bolt rotatably secured to said U-shaped clamp and threadingly received by said U-shaped support bracket; and a lower insert secured against rotation to said support bracket, said lower insert including means for supporting said frame.

42. The clamp assembly according to claim 41 wherein, said means for supporting said frame includes an upper insert being disposed within a channel such that said upper insert engages said frame.

43. The clamp assembly according to claim 41 wherein, said means for supporting said frame includes a channel.

44. The clamp assembly according to claim 41 wherein, said lower insert defines a first slot in engagement with said support bracket and a second slot in engagement with a pin extending from said support bracket.

* * * * *

UNITED STATES PATENT AND TRADEMARK OFFICE

CERTIFICATE OF CORRECTION

PATENT NO. : 6,042,065

DATED : March 28, 2000

INVENTOR(S) : Benjamin C. Benjamin

It is certified that error appears in the above-identified patent and that said Letters Patent is hereby corrected as shown below:

Col. 1, line 67, delete "Figure" and substitute --FIG. 1--

Col. 2, line 17, "FIG." should be --FIGS.--

Col. 2, line 66, delete "slightingly" and substitute --slidingly-- therefor

Col. 3, line 35, delete "slightingly" and substitute --slidingly-- therefor

Col. 3, line 41, delete "an" and substitute --a-- therefor

Col. 3, line 45, delete "slightingly" and substitute --slidingly-- therefor

Col. 3, line 56, "slot 7" should be --slot 74--

Col. 5, line 31, delete "movent" and substitute --movement-- therefor

Col. 6, line 63, delete "it" and substitute --its-- therefor

Col. 7, line 12, delete "chose" and substitute --chosen-- therefor

Col. 7, line 50, claim 1, after "engaging" insert --said front--

Col. 8, line 24, claim 9, after "cylinder" insert --having--

Col. 8, line 59, claim 13, delete "assembly"

UNITED STATES PATENT AND TRADEMARK OFFICE

CERTIFICATE OF CORRECTION

PATENT NO. : 6,042,065

DATED : March 28, 2000

INVENTOR(S) : Benjamin C. Benjamin

It is certified that error appears in the above-identified patent and that said Letters Patent is hereby corrected as shown below:

Col. 10, line 2, claim 28, "delete "based" and substitute --base-- therefor

Col. 10, line 57, claim 39, delete "assembly"

Col. 10, line 59, claim 39, delete "assembly"

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*